US006286986B2

(12) United States Patent
Grimland et al.

(10) Patent No.: US 6,286,986 B2
(45) Date of Patent: Sep. 11, 2001

(54) MULTIPLE TUB MOBILE BLENDER AND METHOD OF BLENDING

(75) Inventors: Kristian E. Grimland, Elizabeth; Timothy Lloyd Anderson, Fort Morgan, both of CO (US)

(73) Assignee: Maverick Stimulation Company, LLC, Denver, CO (US)

( * ) Notice: Subject to any disclaimer, the term of this patent is extended or adjusted under 35 U.S.C. 154(b) by 0 days.

(21) Appl. No.: 09/728,393

(22) Filed: Dec. 4, 2000

Related U.S. Application Data

(62) Division of application No. 09/165,649, filed on Oct. 2, 1998, now Pat. No. 6,193,402.

(51) Int. Cl.[7] ..... B28C 5/08

(52) U.S. Cl. ..... 366/2; 137/8; 137/12; 137/599.01

(58) Field of Search ..... 366/2, 3, 6, 8, 366/14, 15, 17, 21, 27, 28, 134, 136, 182.1, 182.3, 182.4, 184; 137/8, 12, 599.01; 166/285

(56) References Cited

U.S. PATENT DOCUMENTS 2,660,415 * 11/1953 Hawes .
4,003,431 * 1/1977 Novoty et al. .
4,239,396 * 12/1980 Arribau et al. ..... 366/2
4,265,266 * 5/1981 Kierbow et al. .
4,850,702 * 7/1989 Arribau et al. ..... 366/136
4,913,554 * 4/1990 Bragg et al. .
4,915,505 * 4/1990 Arribau et al. ..... 366/136
5,103,908 * 4/1992 Allen ..... 366/17
5,289,877 * 3/1994 Naegele et al. ..... 166/285
5,355,951 * 10/1994 Allen et al. ..... 166/285
5,571,281 * 11/1996 Allen ..... 366/2
6,193,402 * 2/2001 Grimland et al. ..... 366/14

* cited by examiner

*Primary Examiner*—Tony G. Soohoo
(74) *Attorney, Agent, or Firm*—Pittenger & Smith, P.C.

(57) ABSTRACT

An improved oil and gas well servicing apparatus for blending and delivering a slurry of fracturing fluid and particulate matter at constant flow rate and pressure to a downhole pump is disclosed. Multiple blending tubs are mounted on a trailer or skid and are manifolded together in a slurry discharge manifold. The slurry discharge manifold combines the slurry discharged by the blending tubs and incorporates pipe sections of equal length to connect the blending tubs to the manifold. It is believed that the slurry discharge manifold and equal length piping provide balanced pressure drop between the individual blending tubs and creates a constant outlet pressure from the slurry discharge manifold. A fluid intake manifold may also be included to distribute fracturing fluid to the blending tubs. Hose connectors on each of the manifolds are provided on both sides of the apparatus for convenient operation from either side. A conveyer system delivers particulate matter, such as sand, to a distribution bin located above the blending tubs. A source of fracturing fluid may be attached to a hose connector on the fluid intake manifold. The blending tubs utilize a variable drive means placed above each blending tub and suspending an impeller in the blending tub and rotating it about a vertical axis. Thus, a plenum space is provided between the impeller and the bottom of the tub. A tangential outlet is located adjacent to the plenum space and carries the slurry out of the blending tub and into the slurry discharge manifold.

2 Claims, 6 Drawing Sheets

MULTIPLE TUB MOBILE BLENDER AND METHOD OF BLENDING

REFERENCE TO RELATED PATENTS

This application claims the benefit of U.S. Provisional patent application Ser. No. 60/077,170, filed Mar. 6, 1998.

This application is a division of U.S. patent application Ser. No. 09/165,649, filed Oct. 2, 1998 now U.S. Pat. No. 6,193,402 incorporated herein by reference.

FIELD OF THE INVENTION

The present invention relates to a blending apparatus. Specifically, the present invention relates to a blending apparatus used in well fracturing operations. More specifically, the present invention relates to a blending apparatus having multiple mixing tubs.

BACKGROUND OF THE INVENTION

To increase the production of an oil, gas, geothermal, or other type of well, the producing zone of the geological formation surrounding the well is fractured to allow the desired fluids to flow more freely through the formation and into the well. Fluid is pumped into the formation under high pressure to fracture the producing zones. However, if fracturing fluid is pumped into the formation during the fracturing operation without some accompanying solid, the geological formation pressures will cause the fractured areas of the formation to close when the pumping of fracturing fluid stops, thus restricting the flow of the oil or gas.

A slurry of particulate material, such as sand blended with the fracturing fluid, may be forced into the fissures in the geological formation to keep the formation open after the slurry has been pumped into the well. Well servicing equipment incorporates blending apparatus to mix the particulate material with the fracturing fluid. The blender discharges the slurry to a high pressure, downhole pump that injects it into the well and into the producing zones. It is important that the discharge pressure of the blender remains constant to prevent the downhole pump from cavitating, a condition in which inlet fluid flow is reduced or air is passed through the pump and downhole pressure is lost. When cavitation occurs in the downhole pump, the fracturing operation fails.

It is desirable to use multiple blending tubs in the blending and fracturing operations. Multiple blending tubs increase the flow rate and provide a failsafe backup system in the event that one of the tubs fails. However, because of cavitating and other downhole pump problems, it has been difficult to use multiple tubs simultaneously. It is crucial to a cost effective fracturing operation that a high flow rate of slurry is reliably delivered at a relatively constant pressure to the downhole pumping equipment.

INFORMATION DISCLOSURE STATEMENT

The Stegemoeller patents (U.S. Pat. Nos. 4,490,047, 4,802,141, 4,850,701 and 4,913,554) disclose a structure which combines a single mixing tub mounted on a vehicle and having in conjunction an engine for driving hydraulic pumps, additive tanks for use in producing the slurry mixture from the mixing tub, and a control station for operating and monitoring the operation of the system. Throughout these patents, there is considerable discussion concerning the shape and size of the mixing tub. However, there is no teaching in any of the Stegemoeller et al. patents of manifolding multiple blending tubs together to provide a constant outlet pressure.

The Cooper patent (U.S. Pat. No. 4,159,180) discloses a mixing tub mounted on an articulated truck bed. The purpose behind this mechanism is to allow the mixing tub to be rolled off of the truck chassis so that it is resting upon the ground. It is stated that this lower position for the mixing tub allows the tub to be charged with conventional loading equipment instead of having to provide a loading mechanism on the truck itself. The entire system is returned to the truck chassis for transportation purposes. The Cooper patent teaches a single mixing tub and does not disclose the use of multiple tubs.

The Althouse patent (U.S. Pat. No. 4,453,829) discloses a type of mixing tub which utilizes a special impeller for the mixing and blending of the ingredients to form the outlet slurry. This embodiment uses a relatively flat casing with a first impeller having a slinger and a second impeller fastened to a vertical shaft. The second impeller is positioned beneath the slinger portion. The slinger has a toroidal shape which is stated to provide a good pressure balance within the fluid composition for circulating and mixing within the casing. The mixing tub utilizes a reverse centrifugal pump. This mixing tub is used in the servicing of oil wells. The Althouse patent does not teach the use of multiple blending tubs.

The Paulus et al. patent (U.S. Pat. No. 3,050,159) and the Ross et al. patent (U.S. Pat. No. 3,295,698) disclose mobile mixing systems. Both of these patents, however, are directed to batch plants usually for the mixing and pouring of concrete. The Paulus et al. patent discloses a self-erecting portable mixing plant which is transported to the site on a trailer type structure. Upon reaching the site, the structure is erected or elevated into position with the mixer and loading distribution bin elevated to a considerable height to allow the contents of the mixer to be dumped directly into a hauling vehicle. The Ross et al. patent also shows a trailer mounted batch plant whereby a concrete silo is erected into a vertical position with conveyers used for automatically charging a portable mixer with the proper ingredients for concrete. These last two patents are not directly on point, but disclose various types of trailer mounted structures which are used for mixing purposes. These references do not disclose multiple tubs manifolded together to allow the use of two or more tubs simultaneously.

SUMMARY OF THE INVENTION

The present invention provides an improved well servicing apparatus for blending and delivering a slurry of fracturing fluid and particulate matter at a constant flow rate and pressure to a downhole pump. Multiple blending tubs are mounted on a trailer, skid, or other type of supporting vehicle or structure and are manifolded together with a slurry discharge manifold. Pipe sections of equal length connect the blending tubs to the slurry discharge manifolds. The slurry discharge manifold and equal length pipe sections provide balanced pressure between the individual blending tubs. Connections to the manifold are provided on both sides of the support structure for convenient operation from either side. A fluid intake manifold on either or both sides of the apparatus may be included to deliver fracturing fluid to the blending tubs. A source of fracturing fluid, such as a tanker truck, is attached to one or more connections on the fluid intake manifold. A conveyer system delivers particulate matter, such as sand, to a distribution bin located above the blending tubs.

Each blending tub may be cylindrically shaped and powered by a rotating impeller attached to and suspended from a vertical drive shaft. Particulate matter is fed by gravity through the distribution bin into an opening in the top surface of each blending tub. Fracturing fluid is introduced into the blending tub from a tangential inlet located on the upper portion of the blending tub. A plenum space is provided in the tub directly below the rotating impeller. As the fracturing fluid and particulate matter gravitate downward through the tub, they are mixed to form a slurry which exits through a tangential discharge outlet located on the lower portion of the tub adjacent to the plenum. Control valves are located near the inlet and outlet of each blending tub. These valves are used primarily to isolate a blending tub when it is not in use.

Because the inlet and outlet piping to the individual tubs are identical on each tub, the pressure drop in these pipes are relatively the same. This characteristic allows the tubs to automatically balance the pressure within the tubs and manifolds and thus provide a constant outlet pressure to the downhole pump. This self-balancing of the pressures within the tubs and thus the outlet manifold is a critical and unique feature of the present invention.

The start up operation of the blending tubs proceeds as follows. The slurry is mixed in one blending tub with the impeller rotating at 600 rpm or more and the inlet and outlet valves open. The suction pump is operated to provide a pressure of between approximately 25 psi and 38 psi. The impeller of the second tub is brought up to a speed of approximately 600 rpm or more before being filled with fracturing fluid and introducing particulate matter. Once the fracturing fluid and particulate matter begin mixing, the inlet and outlet control valves are opened. The outlet pressures of the two tubs balance and equalize in the outlet manifold, thus providing constant pressure to the downhole pump.

Other features and advantages of the present invention will become apparent from the following detailed description of the invention when it is considered in conjunction with the accompanying drawings.

DETAILED DESCRIPTION OF THE INVENTION

Figure 1:
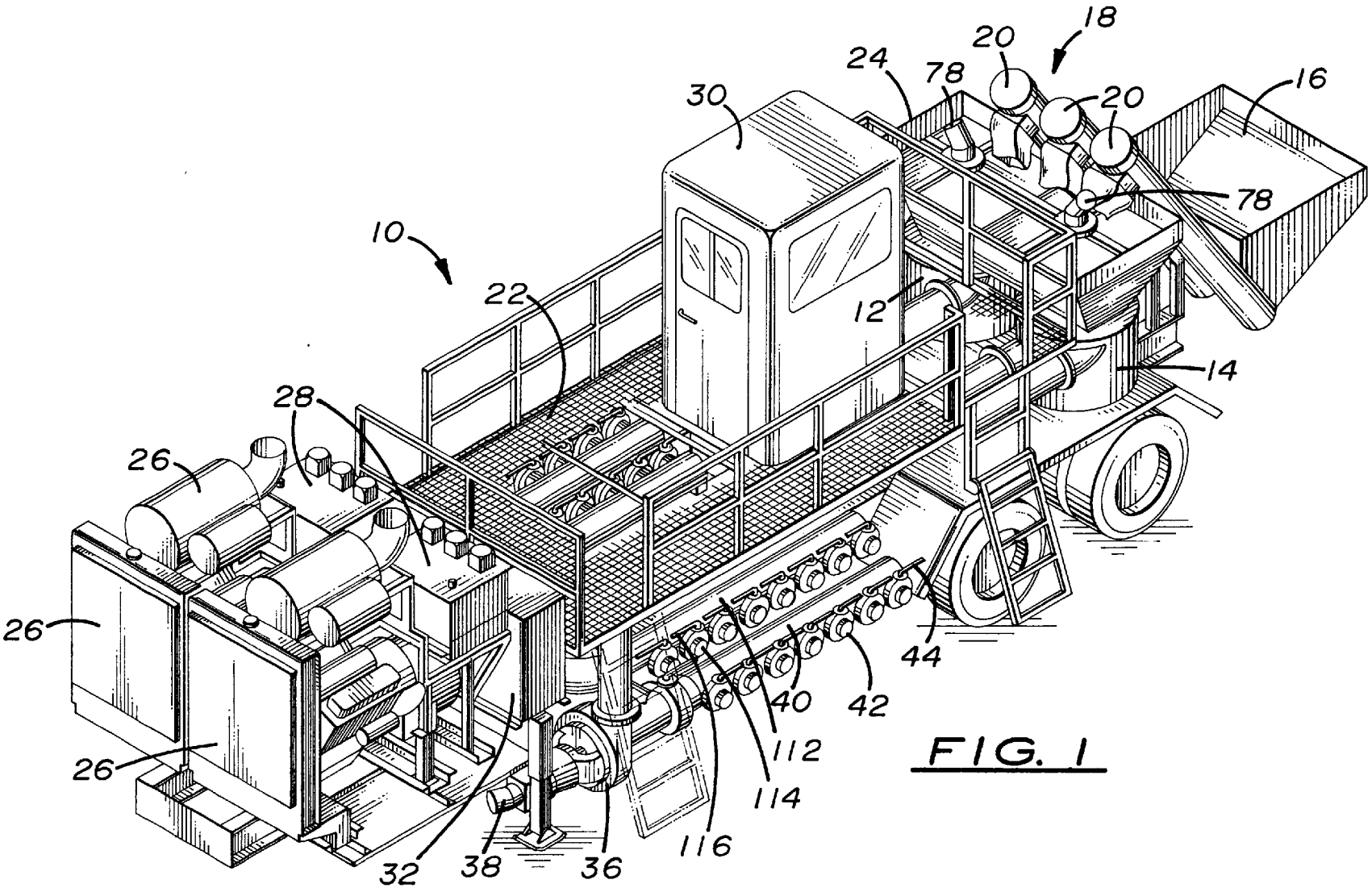
FIGS. 1 and 2 are perspective views of opposite sides of the present invention mounted on a trailer.
Figure 2:
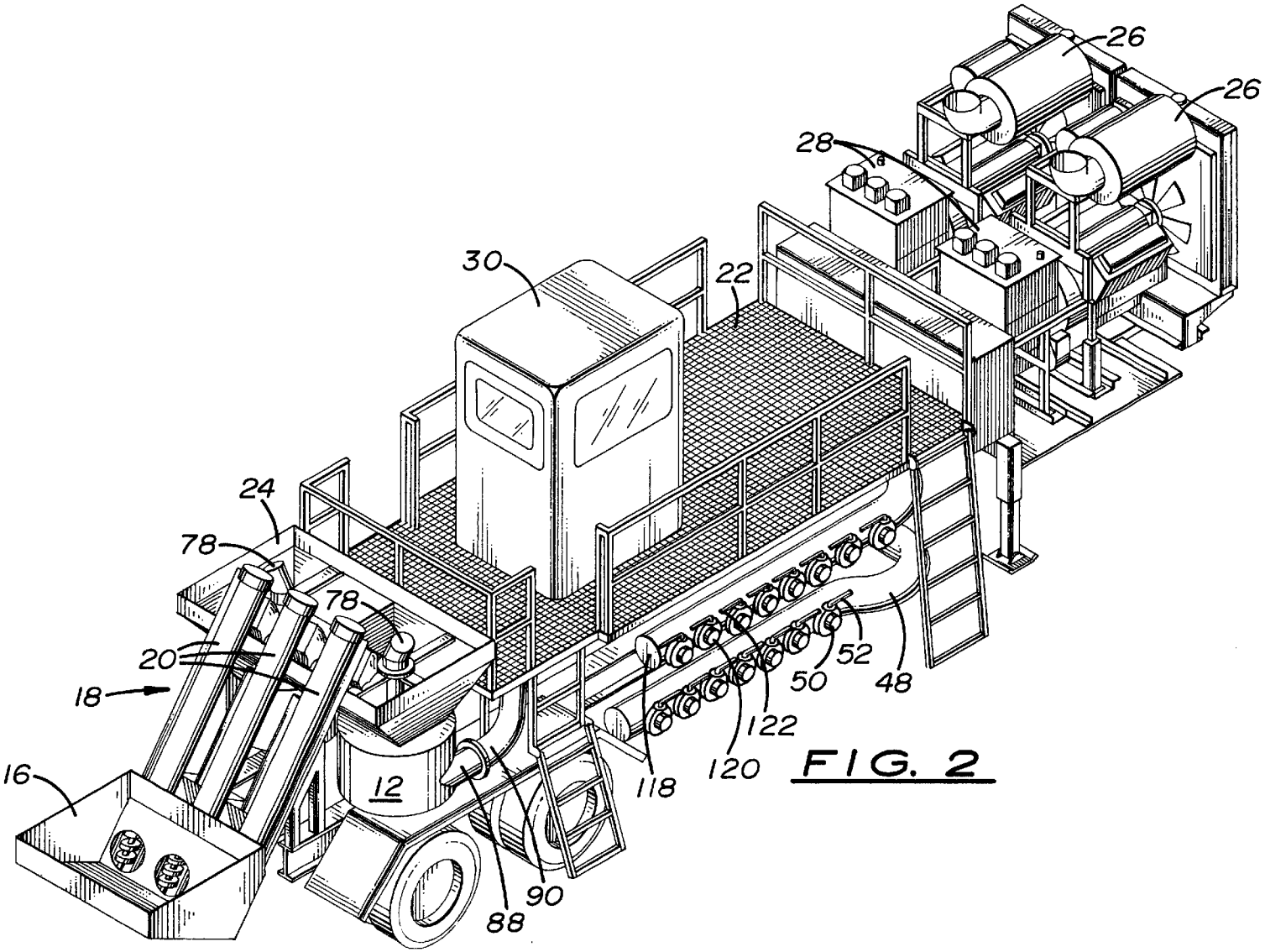
Figure 7:
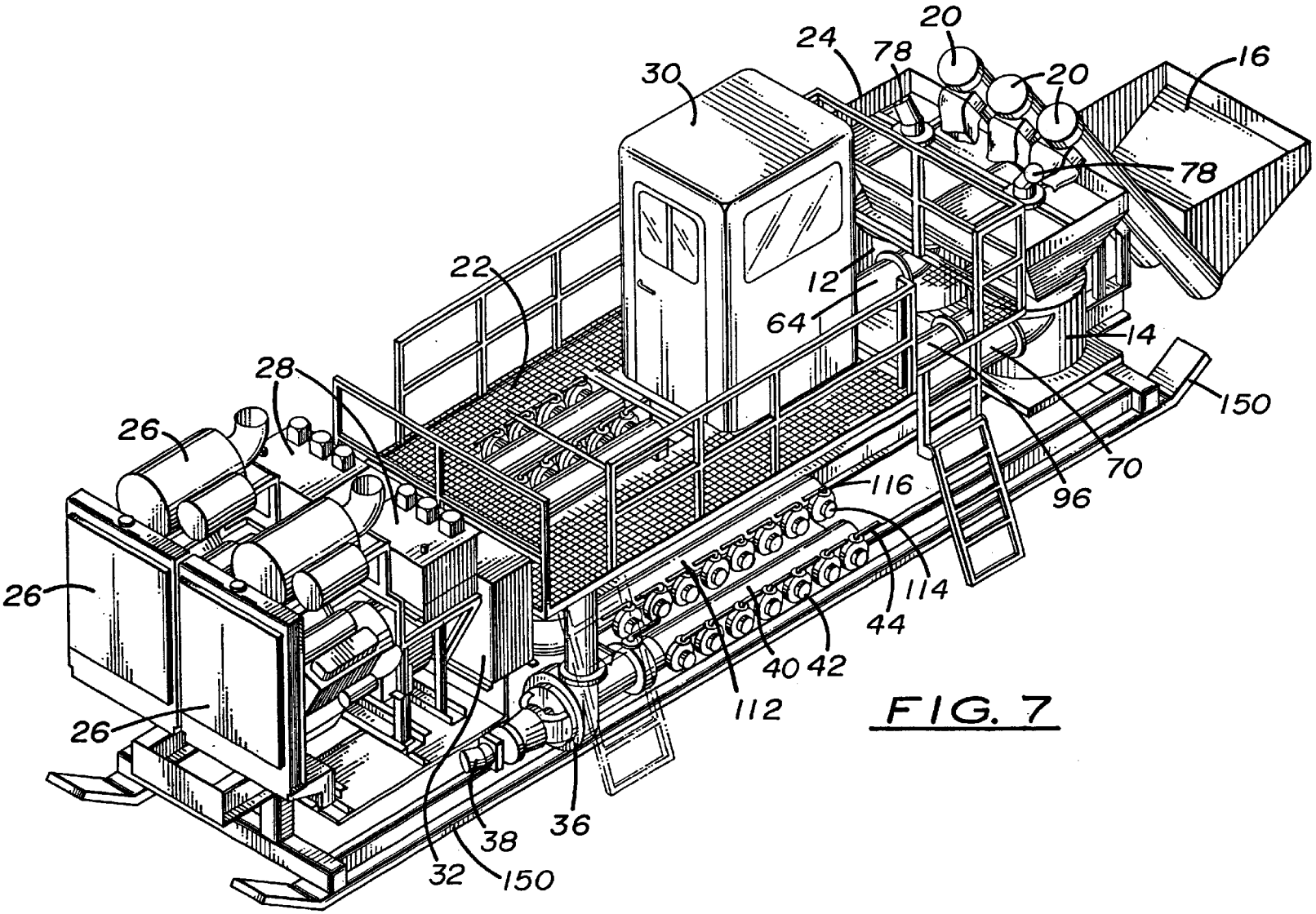
FIG. 7 is a perspective view of an alternative embodiment of the apparatus shown mounted on a skid.

As shown in FIGS. 1 and 2, blending tubs 12, 14 are mounted on a trailer 10 or skid 150 (FIG. 7). A conveyer system 18 may be used to deliver particulate matter, such as sand, from a hopper 16 to a distribution bin 24 located above the blending tubs 12, 14. The conveyer system 18 may incorporate a plurality of augers 20, each enclosed by a cylindrical sleeve, and capable of feeding particulate matter from a hopper 16 to the distribution bin 24 through a positive displacement screw. The augers 20 may be powered simultaneously or separately, depending on the required amount of particulate matter. The speed of each auger 20 may be independently controlled, thus providing adjustment and control over the amount of particulate matter that is fed to each of the blenders. A slidable or otherwise movable baffle may be provided within the distribution bin 24 for diverting and controlling the flow of particulate matter to the individual blending tubs 12, 14.

Two large diesel engines 26 may be used to power the apparatus. Each engine 26 powers a separate hydraulic pump 28 and reservoir 32, which drives an individual blending tub, and one or more augers 20 in the conveyor system 18. The hydraulic pumps 28 may drive the drive unit 38 and suction pump 36 individually or in combination. While hydraulic power systems are used in the preferred embodiment of the present invention, it is to be understood that other types of power systems, including electric motors or internal combustion engines, may be used to power the apparatus.

The main control system 30, located in a cab in the central area of the trailer 10, controls the auger speeds, suction pump speed, and control valves, as well as the rotary drive units 78 connected to the impellers 74 in the blending tubs 12, 14. A suitable computer may be used to control the operation of the system so that a desired slurry density is achieved. While the main control system 30 is located on deck 22, it may be remotely located.

Figure 3:
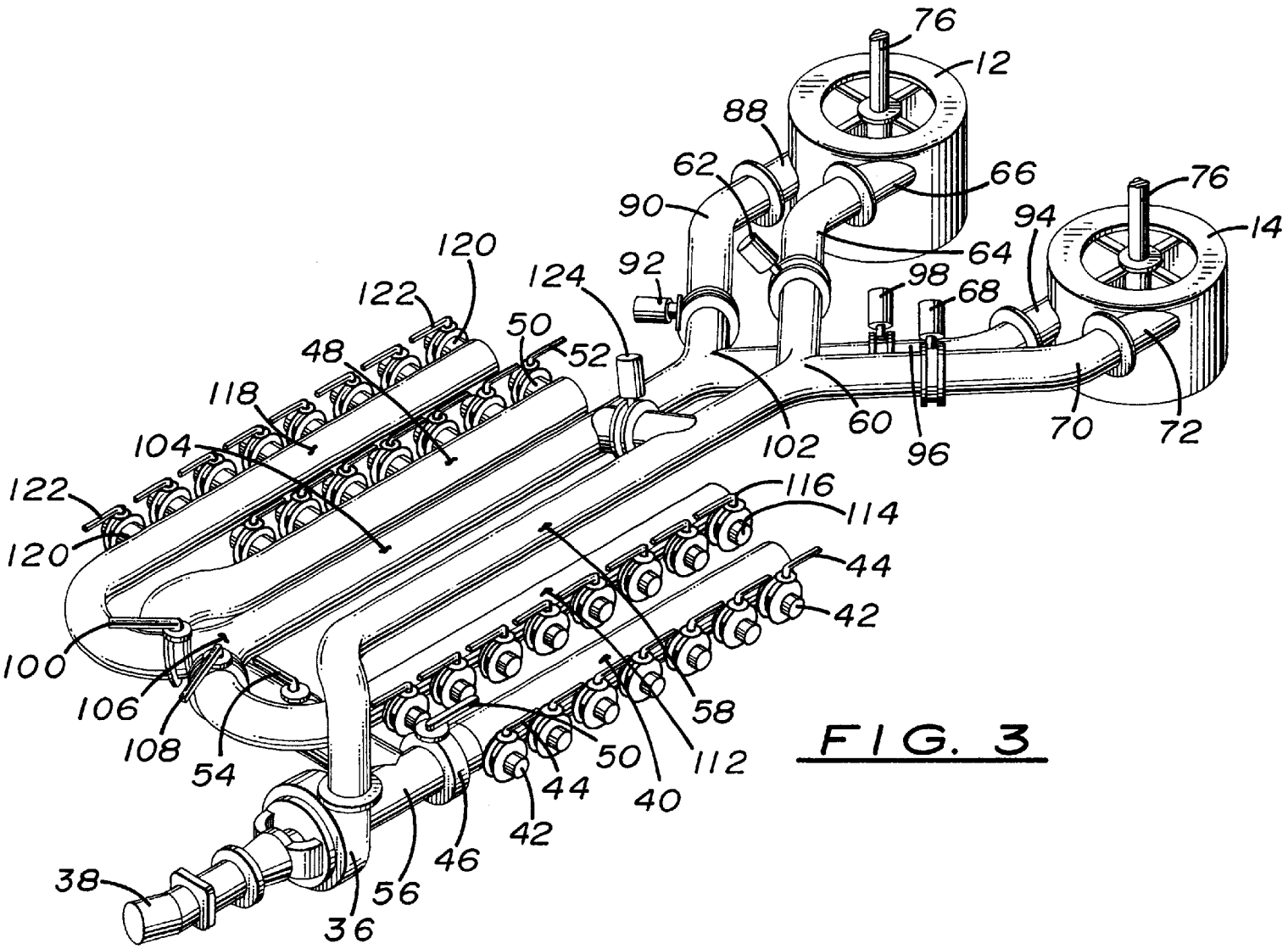
FIG. 3 is a perspective view of the blending tubs and piping for the fluid intake manifold and slurry discharge manifold.
Figure 6:
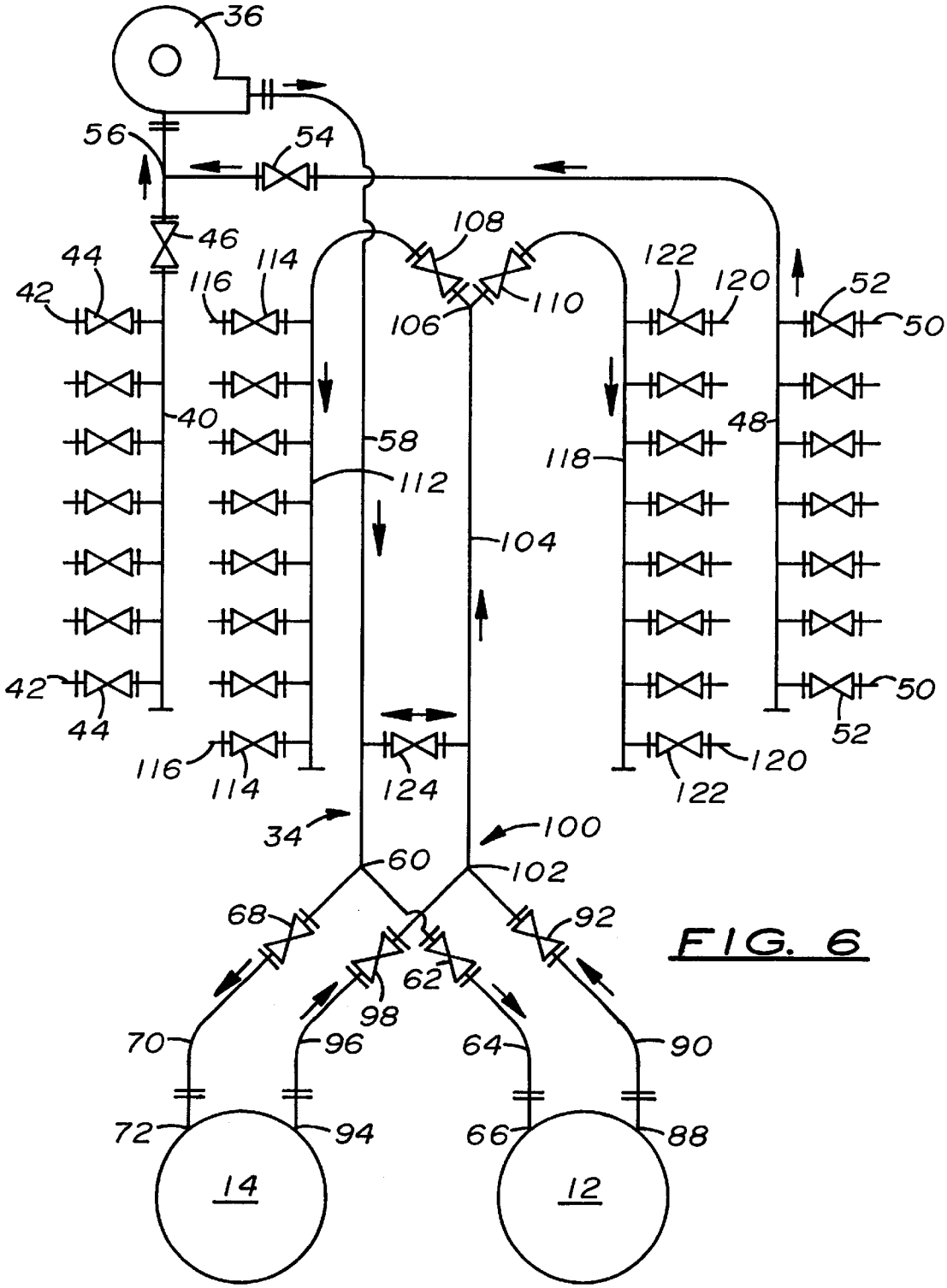
FIG. 6 is a diagram in schematic form illustrating the fluid intake manifold and slurry discharge manifold.

FIGS. 3 and 6 illustrate the manifold systems that connect the blending tubs 12, 14. The fluid intake manifold 34 includes a hydraulic suction pump 36, hydraulic drive unit 38, left intake bank 40, right intake bank 48, T-junction 56, main intake pipe 58, and a Y-junction 60. The suction pump 36, powered by the drive unit 38, supplies fracturing fluid to the blending tubs 12, 14 through the main intake pipe 58, and includes a speed control for controlling the combined rate of fluid flow to the blending tubs 12, 14. The left and right intake banks 40, 48 are positioned on both sides of the apparatus to allow convenient positioning of one or more sources of fracturing fluid. Water, diesel fuel, gelled solution, or other suitable solutions may be used for the fracturing fluid. Hose connectors 42 and shut off valves 44 are included with the left intake bank 40. Hose connectors 50 and shut off valves 52 are included with the right intake bank 48. The T-junction 56 connects the left intake bank 40 and right intake bank 48 with the pump 36 and the main intake pipe 58. Bank valves 46, 54 allow the left and right intake banks 40, 48, respectively, to be operated separately or in combination. The Y-junction 60 connects the main intake pipe 58 to equal length pipe sections 64, 70, which deliver the fracturing fluid to the blending tubs 12, 14, respectively. Pipe section 64 connects to tangential inlet 66 on blending tub 12 and pipe section 70 connects to tangential inlet 72 on blending tub 14. Pipe section 64 includes control valve 62 and pipe section 70 includes control valve 68. Control valves 62, 68 allow the blending tubs 12, 14 to be operated separately or in combination.

Figure 4:
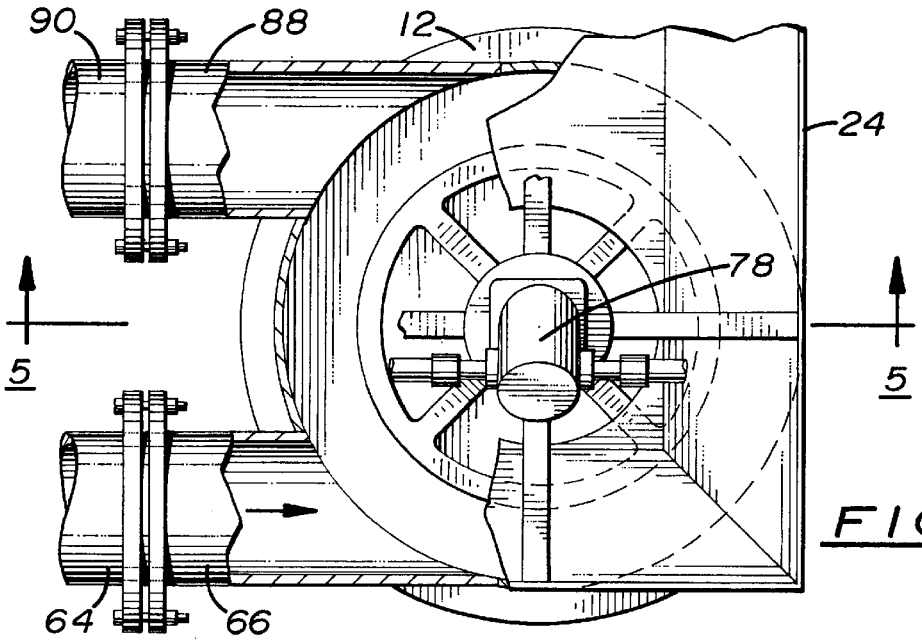
FIG. 4 is a plan view of the blending tub, drive unit, and associated inlet and outlet pipe sections.
Figure 5:
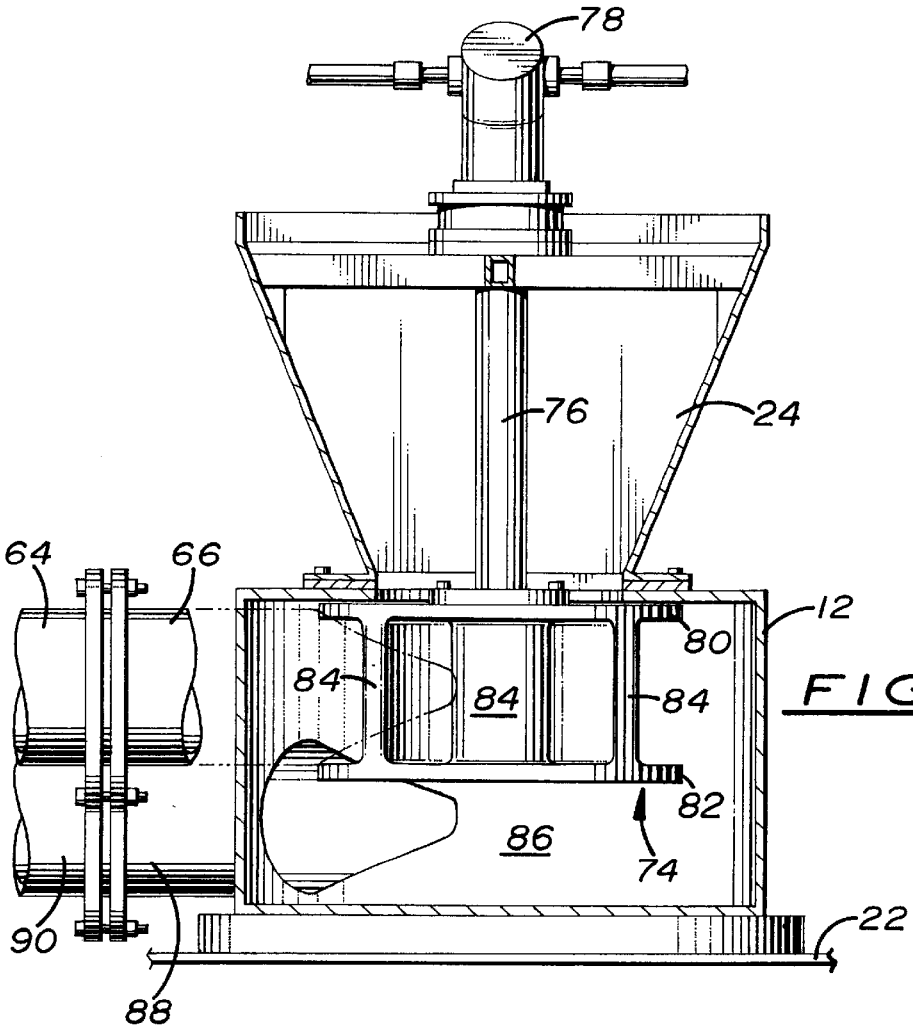
FIG. 5 is a partial side view of the blending tub, distribution bin, and drive unit, showing the lower cavity area.

The blending tubs 12, 14 may be cylindrically shaped, with a closed bottom surface and a partially open top surface. FIGS. 4 and 5 show the blending tub 12. Blending tub 14 may be configured similar to blending tub 12. As shown in FIGS. 4 and 5, the blending tub 12 includes a horizontally rotating impeller 74. A drive shaft 76 protrudes vertically upward through the top of the tub and connects to a hydraulic drive unit 78. Particulate matter is fed by gravity through the distribution bin 24 and into an opening in the top surface of the blending tub 12. Sand, glass beads, walnut shells, poly abrasive or other suitable materials may be used as the particulate matter. Fracturing fluid is introduced into the blending tub 12 by a tangential inlet 66 located in the upper portion of the blending tub 12. A plenum space 86 is provided in the blending tub 12 below the rotating impeller 74. As the fracturing fluid and particulate matter gravitate downward through the blending tub 12, they are mixed into a slurry and exit through a tangential discharge outlet 88 located on the lower portion of the blending tub 12.

The impeller 74 comprises an upper ring 80 and a lower disk 82 sharing a common axis of rotation defined by the drive shaft 76. The impeller 74 may be positioned horizontally. The open area surrounded by the upper ring 80 allows the drive shaft 76 to connect to the lower disk 82. The upper ring 80 and lower disk 82 are connected to each other by a plurality of blade members 84 mounted perpendicularly between the upper ring 80 and lower disk 82 at the periphery. The upper ring 80, lower disk 82 and blade members 84 are constructed of hardened steel or other suitable material capable of withstanding the abrasive and erosive characteristics of the slurry. The diameter of the impeller 74 is smaller than the inner diameter of the tub and allows sufficient clearance for the fluid and particulate matter to pass. The impeller 74 is suspended by the drive shaft 76 approximately eight to ten inches above the bottom of the tub, thus creating the plenum space 86 at the bottom of the tub under the impeller 74. It is believed that a buoyancy factor created within the plenum space 86 helps balance the individual tub pressures in the slurry discharge manifold 100.

The slurry discharge manifold 100 carries the slurry from the blending tubs 12, 14. Slurry exits the blending tub 12 from tangential outlet 88 and blending tub 14 from tangential outlet 94. Tangential outlets 88, 94 are connected to equal length pipe sections 90 and 96, respectively. Pipe section 90 includes control valve 92, and pipe section 96 includes control valve 98. Control valves 92, 98, in combination with control valves 62, 68, allow the blending tubs 12, 14 to be operated separately or in combination. The slurry discharge manifold 100 includes Y-junction 102, main discharge pipe 104, left discharge bank 112 and right discharge bank 118. Y-junction 102 connects the pipe sections 90 and 96 to the main discharge pipe 104. The main discharge pipe 104 is connected to a second Y-junction 106, and control valves 108, 110, where the slurry may be distributed between the left discharge bank 112 and right discharge bank 118, respectively. Left discharge bank 112 includes hose connectors 116 controlled by shut off valves 114. Right discharge bank 118 includes hose connectors 120 controlled by shut off valves 122. The pressure from the blending tubs is sufficient to carry the slurry through the slurry discharge manifold 100. A cross-over valve 124 connects the main intake pipe 58 and the main discharge pipe 104. The cross-over valve 124 allows the tubs to be completely bypassed and delivers fracturing fluid directly to the left and right discharge banks 112, 118.

It appears that the equal length pipe sections 90 and 96 are critical to producing the constant and balanced outlet pressure. This is apparently true in the manifolding together of any number of blending tubs. Thus, alternative embodiments of the present invention may incorporate numerous additional blending tubs. Additionally, the provision of the plenum 86 in the bottom area of the tub below the impeller 74 with the outlet pipe connected to the tub in this lower area also contributes to and enhances the balancing of the outlet pressure from each tub to provide the constant outlet pressure necessary for downhole fracturing operations.

The base structure may incorporate a chassis which can be mounted or built on a semi-trailer, skid frame, vessel, or other structure. The complete apparatus may be constructed for operation in any type of environment where well servicing is required.

Operation

The operation of both blending tubs 12, 14 is performed as follows. A source of fracturing fluid is connected to one or more of the intake hose connectors 42, 50. Upon startup of the deck engines 26, the hydraulic pumps 28 are activated. The suction pump 36 is activated, and the fracturing fluid is drawn into the fluid intake manifold 34. To balance the inlet pressure against the pressure of the tubs, the slurry is mixed in the blending tub 12 with the impeller rotating at approximately 600 rpm or greater and the inlet control valve 62 and outlet control valve 92 open. The conveyor augers 20 are activated, and particulate matter is transported from the hopper 16 to the distribution bin 24. The particulate matter is then distributed to the blending tub 12.

The slurry is passed through the slurry discharge manifold 100 and one or more of the discharge hose connectors 116, 120 to a connected downhole pumping apparatus. The second tub 14 is operated at approximately the speed of the first tub before being filled with fracturing fluid and introducing the particulate matter. Once the fracturing fluid and particulate matter begin mixing, the inlet and outlet control valves 68 and 98 are opened on the second blending tub. The outlet pressures of the blending tubs 12, 14 balance and equalize in the discharge manifold 100, thus providing constant pressure to the downhole pump. The resulting constant outlet pressure from the tubs prevents the slurry from overflowing or exiting the tops of the blending tubs. The discharge pressure from the discharge manifold 100 is approximately 5 PSI greater than the pressure in the intake manifold 34.

In the preferred embodiment of the invention, the slurry is mixed to a density of up to approximately 22 pounds of particulate matter per gallon of fracturing fluid. The discharge flow rate per blending tub is approximately 40 barrels per minute, with a combined flow rate of 80 barrels per minute for both blending tubs operated simultaneously. The discharge pressure is approximately 50–60 psi. Both blending tubs 12, 14 remain in operation without the use of throttle valves, and no leveling of the blending tubs is required.

An apparatus that balances the pressures of multiple blending tubs while maintaining a constant balanced output pressure has been illustrated and described in detail. It is to be understood that details of the present invention may be modified without departing from the spirit thereof.

What is claimed is:

1. A method of blending a slurry in multiple blending tubs for servicing oil and gas wells, said method comprising the steps of:

(a) blending particulate matter and liquid simultaneously in a plurality of blending tubs;

(b) balancing the discharge pressures from each of the blending tubs so that they are equal;

(c) manifolding the balanced discharge pressure from said blending tubs together in a common manifold; and (d) providing a constant outlet pressure from said manifold for servicing oil and gas wells.

2. A method of blending a slurry in multiple blending tubs for servicing oil and gas wells, said method comprising the steps of:

(a) operating a first blending tub having an inlet and outlet means and containing a slurry of particulate matter and liquid, the inlet means and outlet means of said first blending tub being in an open position;

(b) operating a second blending tub having a closed inlet and outlet means and containing liquid;

(c) adding particulate matter to said second blending tub and blending a slurry;

(d) opening the inlet means and outlet means on said second blending tub; and (e) balancing the outlet pressures of said blending tubs in a manifolding means to provide a constant outlet pressure from said manifolding means.

* * * * *